US011183157B2

(12) United States Patent
Lillywhite

(10) Patent No.: US 11,183,157 B2
(45) Date of Patent: Nov. 23, 2021

(54) TENSION MECHANISM FOR JOINTS OF WIND INSTRUMENTS

(71) Applicant: Cannonball Musical Instruments, LLC, Sandy, UT (US)

(72) Inventor: Ryan Lillywhite, Sandy, UT (US)

(73) Assignee: Cannonball Musical Instrument, LLC, Sandy, UT (US)

( * ) Notice: Subject to any disclaimer, the term of this patent is extended or adjusted under 35 U.S.C. 154(b) by 0 days.

(21) Appl. No.: 16/775,048

(22) Filed: Jan. 28, 2020

(65) Prior Publication Data

US 2020/0243053 A1 Jul. 30, 2020

Related U.S. Application Data

(60) Provisional application No. 62/797,773, filed on Jan. 28, 2019.

(51) Int. Cl.
*G10D 9/00* (2020.01)

(52) U.S. Cl.
CPC ..... *G10D 9/00* (2013.01)

(58) Field of Classification Search
CPC ..... G10D 9/00; G10D 7/08; G10D 3/00
See application file for complete search history.

(56) References Cited

U.S. PATENT DOCUMENTS

2015/0269918 A1* 9/2015 Wang ..... G10D 7/08 84/385 R

FOREIGN PATENT DOCUMENTS

DE 202006020129 U1 * 11/2007 ..... G10D 9/02

* cited by examiner

*Primary Examiner* — Kimberly R Lockett
(74) *Attorney, Agent, or Firm* — Libby Babu Varghese; Scarinci Hollenbeck LLC

(57) ABSTRACT

A wind instrument neck receiver tension mechanism is provided having a body, a retaining ridge, and a tension band. The body has a lower body end and a upper body end. The upper body end defines a thin collar seating wall, which has at least one notch. In some embodiments there are four equally sized notches. A retaining ridge extends from the thin collar seating wall and a tension band having an adjustable compression ring, the adjustable compression ring disposed between said thin collar seating wall and the retaining ridge. When adjusted to a first position, the compression ring compresses the thin collar seating wall in a uniform compression around a circumference of a neck receiver of a wind instrument.

15 Claims, 4 Drawing Sheets

TENSION MECHANISM FOR JOINTS OF WIND INSTRUMENTS

FOREIGN PRIORITY CLAIM

This application is based upon and claims the benefit of priority to U.S. provisional patent application No. 62/797,773, filed on Jan. 28, 2019, the entire contents of which are incorporated herein by reference.

FIELD OF THE INVENTION

The present application is related generally to a tension mechanism for a joint of a wind instrument and more particularly to a neck receiver for a wind instrument which provides a uniform concentric compression around the circumference of the receiver.

BACKGROUND OF THE INVENTION

A typical saxophone neck receiver tension mechanism is generally accomplished with a tenon-in-socket joint, with a single slit in the neck socket that is compressed by tightening of a neck tension screw to hold the neck of the instrument in place.

Having a single slit in the neck socket of a wind instrument creates a non-uniform compression around the circumference of the neck receiver, which can detrimentally impact the tone and performance of the wind instrument. What is desired is to have a neck receiver for a wind instrument which provides a uniform concentric compression around the circumference of the receiver.

SUMMARY OF THE INVENTION

A wind instrument neck receiver tension mechanism is provided having a body, a retaining ridge, and a tension band. The body has a lower body end and a upper body end. The upper body end defines a thin collar seating wall, which has at least one notch. In some embodiments there are four equally sized notches. A retaining ridge extends from the thin collar seating wall and a tension band having an adjustable compression ring, the adjustable compression ring disposed between said thin collar seating wall and the retaining ridge. When adjusted to a first position, the compression ring compresses the thin collar seating wall in a uniform compression around a circumference of a neck receiver of a wind instrument.

DETAILED DESCRIPTION OF THE INVENTION

Figure 1:
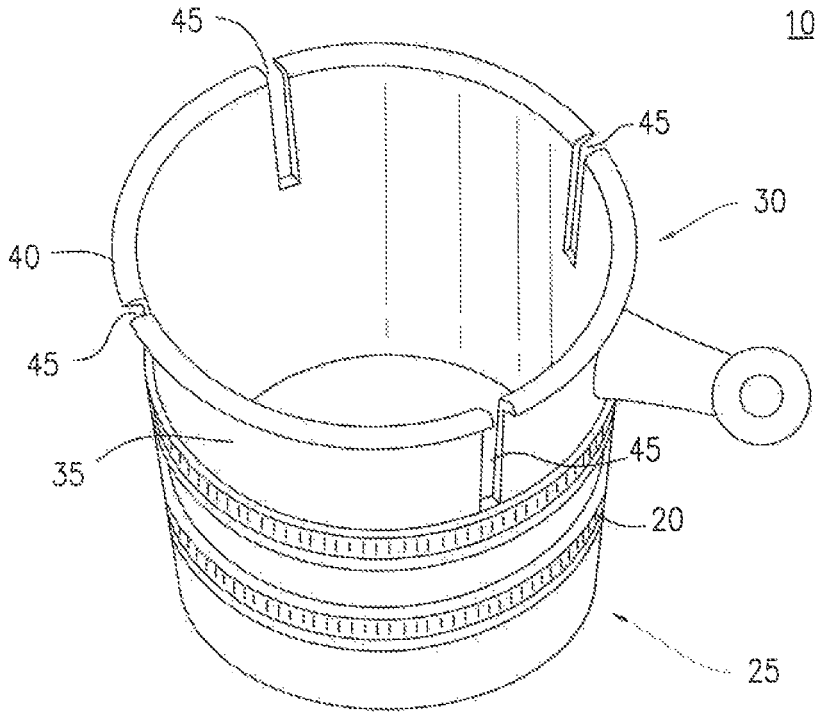
FIG. 1 shows a perspective view of a neck receiver in accordance with an embodiment of the invention.

As discussed above, a preferred embodiment of the improved neck receiver provides a more uniform compression around the circumference of a saxophone neck. In FIG. 1, a perspective view of a neck receiver 10 in accordance with an embodiment of the invention is shown. The neck receiver 10 is comprised of a body 20, with a lower end 25 for permanent attachment to a saxophone body, shown below. Upper end 30 of body 20 exhibits a cylindrical thin collar seating wall 35. A retaining ridge 40 extends circumferentially outward from the entire circumference of the cylindrical thin collar seating wall 35. Notches 45 divide the cylindrical thin collar seating wall 35, in an exemplary embodiment, into four approximately equal sized portions.

Figure 2:
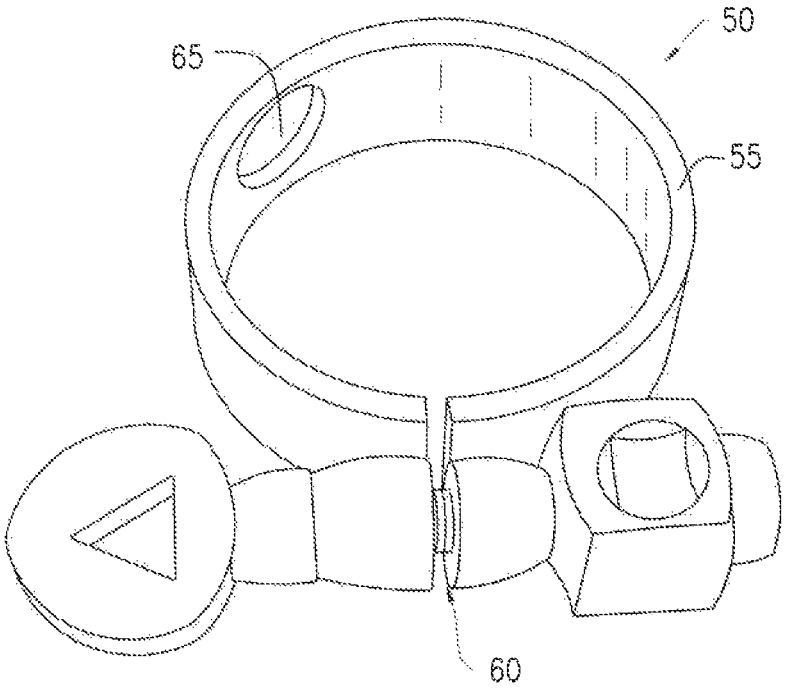
FIG. 2 shows a perspective view of a tension band for use with the neck receiver of FIG. 1.

In FIG. 2, a tension band 50 is shown for use with the neck receiver 10 of FIG. 1. Tension band 50 is comprised of a compression ring 55 integrated with a tightening nut and bolt 60, As the tightening nut is turned in a first direction, the diameter of compression ring 55 is reduced, thus imparting an inwardly directed compression force. Hole 65 is provided in an exemplary embodiment to allow post 70 to fit within the area of thin collar seating wall 35 as described below.

Figure 3:
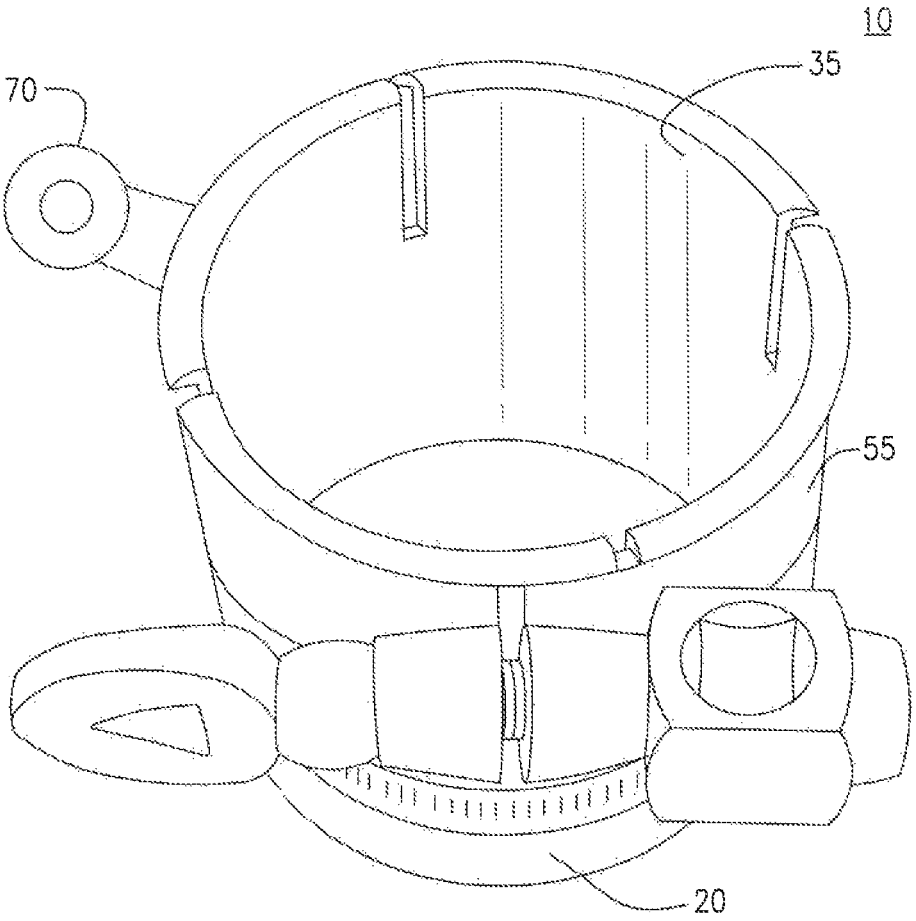
FIG. 3 shows a perspective view of the neck receiver of FIG. 1, showing the tension band in an installed position on the neck receiver of FIG. 1.

In FIG. 3, the tension band 50 is shown in an installed position on the neck receiver 10. In this view, the compression ring 55 fits within the channel formed by thin collar seating wall 35 and retaining ridge 40 of body 20. Post 70 protrudes through hole 65 to allow for normal operation of the saxophone neck. as described below.

Figure 4:
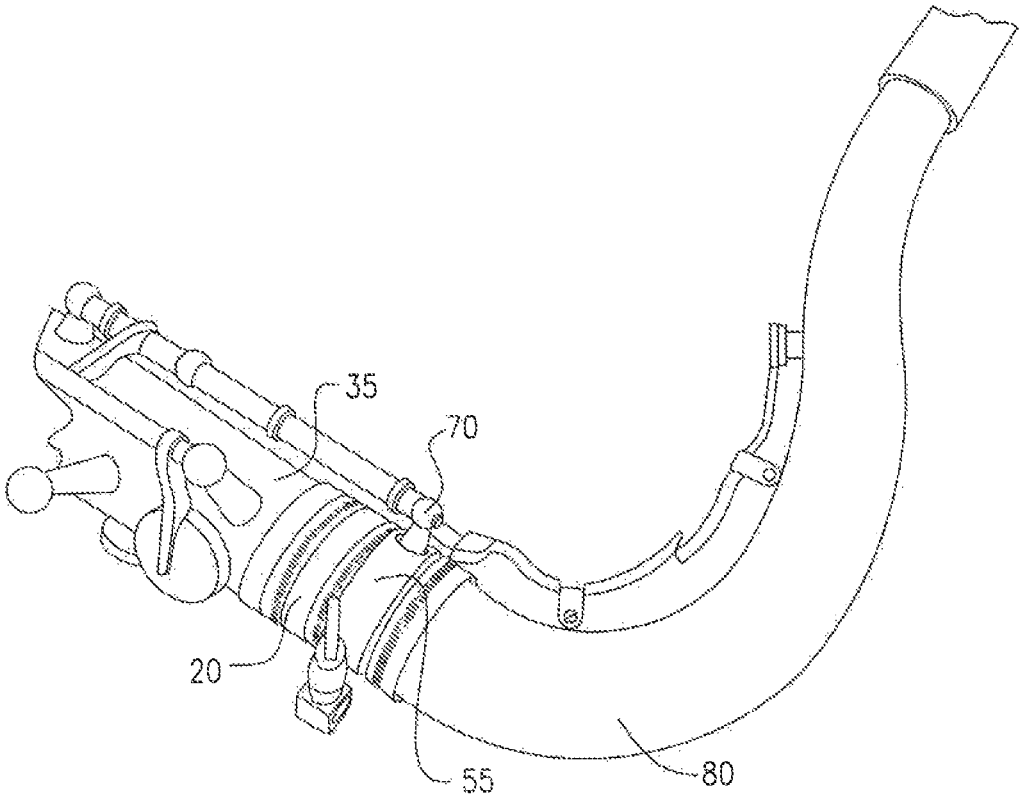
FIG. 4 illustrates a side view of the neck receiver of FIG. 1, showing the neck receiver installed on the upper portion of a saxophone and engaged with a saxophone neck.

In FIG. 4, the neck receiver 10 is shown installed on the upper portion of saxophone 75 and engaged with saxophone neck 80. Once saxophone neck 80 is inserted into the upper portion of neck receiver 10, rotation of the tightening nut into bolt 60 imparts an inwardly directed compression of the thin collar seating wall in a uniform compression around the circumference of neck receiver 10. It can be appreciated that while the description is directed generally toward a saxophone neck receiver, the subject invention can be utilized on many types of woodwind instruments; such as a flute, oboe, piccolo, bassoon, bagpipe, or the like.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention.

I claim:

1. A wind instrument comprising a neck receiver tension mechanism comprising:

a body having a post, a lower body end and an upper body end defining a thin collar seating wall, said thin collar seating wall having at least one notch;

a retaining ridge extending from the thin collar seating wall; and a tension band comprising an adjustable compression ring, said adjustable compression ring disposed between said thin collar seating wall and the retaining ridge, said adjustable compression ring having a compression ring hole, wherein said compression ring hole is dimensioned and configured to receive said post;

wherein adjusting said compression ring in a first position compresses the thin collar seating wall in a uniform compression around a circumference of a neck receiver of said wind instrument.

2. The wind instrument in claim 1, wherein the lower body end is attachable to a body of the wind instrument.

3. The wind instrument in claim 1, wherein the lower body end is permanently attachable to a body of the wind instrument.

4. The wind instrument in claim 1, wherein there are at least two notches.

5. The wind instrument in claim 1, wherein the notches are equal in size.

6. The wind instrument in claim 1, wherein the adjustable compression ring employs a nut and bolt.

7. The wind instrument in claim 1, wherein there are four notches.

8. The wind instrument in claim 1, wherein the wind instrument is a flute.

9. The wind instrument in claim 1, wherein the wind instrument is an oboe.

10. The wind instrument in claim 1, wherein the wind instrument is a piccolo.

11. The wind instrument in claim 1, wherein the wind instrument is a bassoon.

12. The wind instrument in claim 1, wherein the wind instrument is a bagpipe.

13. The wind instrument in claim 1, wherein the wind instrument is a saxophone.

14. A neck receiver tension mechanism comprising:

a neck receiver body having a post, a lower neck receiver body end and an upper neck receiver body end, said neck receiver body having at least one notch; and a tension band comprising an adjustable compression ring, said adjustable compression ring having a compression ring hole, wherein said compression ring hole is dimensioned and configured to receive said post;

wherein said compression ring is dimensioned and configured to cover said notch on said neck receiver body;

wherein adjusting said compression ring in a first position compresses the neck receiver body in a uniform compression around a circumference of a neck receiver of a wind instrument.

15. The neck receiver tension mechanism in claim 14, wherein there are at least two notches.

* * * * *